US009114277B2

(12) United States Patent
Goeckel

(10) Patent No.: US 9,114,277 B2
(45) Date of Patent: Aug. 25, 2015

(54) EXERCISE BRACE

(76) Inventor: Gregory William Goeckel, Belleville, IL (US)

( * ) Notice: Subject to any disclaimer, the term of this patent is extended or adjusted under 35 U.S.C. 154(b) by 574 days.

(21) Appl. No.: 13/440,179

(22) Filed: Apr. 5, 2012

(65) Prior Publication Data

US 2012/0264576 A1 Oct. 18, 2012

Related U.S. Application Data

(60) Provisional application No. 61/474,791, filed on Apr. 13, 2011.

(51) Int. Cl.

| | |
|---|---|
| ***A63B 21/02*** | (2006.01) |
| ***A63B 21/04*** | (2006.01) |
| ***A63B 21/00*** | (2006.01) |
| ***A63B 21/055*** | (2006.01) |
| ***A63B 23/04*** | (2006.01) |
| ***A63B 23/12*** | (2006.01) |

(52) U.S. Cl.

CPC ..... *A63B 21/0414* (2013.01); *A63B 21/0004* (2013.01); *A63B 21/00069* (2013.01); *A63B 21/0421* (2013.01); *A63B 21/0552* (2013.01); *A63B 21/1423* (2013.01); *A63B 21/1434* (2013.01); *A63B 21/1492* (2013.01); *A63B 23/0494* (2013.01); *A63B 23/1281* (2013.01)

(58) Field of Classification Search

CPC ..... A63B 21/0004; A63B 21/00043; A63B 21/0414; A63B 21/0421; A63B 21/0552; A63B 21/1423; A63B 21/1434; A63B 21/1492; A63B 23/0494; A63B 23/1281; A61F 5/0102; A61F 5/0123; A61F 5/0125; A61F 5/013; A61F 2005/0165; A61F 2005/0167; A61F 2005/0169; A61F 2005/0179; A61F 2005/0197

USPC ..... 482/105, 121, 122, 124, 129, 139, 148; 602/16, 20, 23, 24, 26, 5; 601/23, 33, 601/34

See application file for complete search history.

(56) References Cited

U.S. PATENT DOCUMENTS

| | | | | |
|---|---|---|---|---|
| 3,976,057 | A * | 8/1976 | Barclay | 601/34 |
| 4,433,679 | A * | 2/1984 | Mauldin et al. | 602/16 |
| 4,606,542 | A * | 8/1986 | Segal | 482/124 |
| 5,042,799 | A * | 8/1991 | Stanley | 482/123 |
| 5,213,094 | A * | 5/1993 | Bonutti | 601/33 |
| 5,337,737 | A * | 8/1994 | Rubin et al. | 601/33 |
| 5,456,268 | A * | 10/1995 | Bonutti | 128/898 |
| 5,685,830 | A * | 11/1997 | Bonutti | 602/16 |
| 5,865,714 | A * | 2/1999 | Marlowe | 482/112 |
| 6,117,097 | A * | 9/2000 | Ruiz | 602/26 |
| 6,537,237 | B1 * | 3/2003 | Hopkins et al. | 602/5 |
| 7,048,704 | B2 * | 5/2006 | Sieller et al. | 602/16 |
| 2011/0207585 | A1 * | 8/2011 | Burns | 482/124 |

* cited by examiner

*Primary Examiner* — Stephen Crow
*Assistant Examiner* — Gregory Winter
(74) *Attorney, Agent, or Firm* — Thomas E. Lees, LLC

(57) ABSTRACT

An exercise device includes an exercise brace, a first strap, a second strap and a resistance band. The exercise brace includes a first frame member and a second frame member that pivotably couples to the first frame member. The first strap couples to the first frame member about an end portion thereof to temporarily attach the exercise device to a user. Similarly, the second strap couples to the second frame member about an end portion thereof to temporarily attach the exercise device to the user. The resistance band couples to the exercise brace such that the resistance band creates a resistance to pivoting movement between the first frame member and the second frame member.

17 Claims, 7 Drawing Sheets

EXERCISE BRACE

CROSS REFERENCE TO RELATED APPLICATIONS

This application claims the benefit of U.S. Provisional Patent Application Ser. No. 61/474,791, filed Apr. 13, 2011, entitled "EXERCISE BRACE", the disclosure of which is hereby incorporated by reference in its entirety.

BACKGROUND

Various aspects of the present invention relate generally to a device for exercising, and more particularly, to a brace that is worn during exercise to provide arm and/or leg workouts.

Physical exercise is a recognized beneficial bodily activity that can be used for fitness, therapeutic purposes and health purposes. In order to promote physical exercise, a wide range of exercise devices are commercially available. For instance, exercise devices may take the form of free weights, including barbells, dumbbells and kettlebells. Unfortunately, barbells require a plurality of disc plates of varying weight to provide a satisfactory workout. Also, dumbbells and kettlebells come in a wide range of weights. As such, a user may be inclined to purchase dumbbells and kettlebells in sets, requiring a large area to store the equipment.

Exercise devices may also take the form of weight resistance machines. Typical weight resistance machines require a user to sit, lay on or stand adjacent to different stations, components or features of the machine to work out different muscle groups. These machines are large, expensive and cumbersome. Even exercise devices designed to facilitate cardiovascular workouts, e.g., treadmills, stairclimbers and elliptical machines, are large, bulky and expensive.

BRIEF SUMMARY

According to aspects of the present invention, an exercise device comprises an exercise brace, a first strap, a second strap, a resistance band and at least one band engaging member. The exercise brace includes a first frame member and a second frame member that pivotably couples to the first frame member. The first strap couples to the first frame member about an end portion thereof to temporarily attach the exercise device to a user. Similarly, the second strap couples to the second frame member about an end portion thereof to temporarily attach the exercise device to the user. The resistance band couples to the exercise brace. Moreover, at least one band engaging member extends from the exercise brace, each band engaging member arranged such that when the resistance band is brought into contact with the band engaging member, the resistance band creates a resistance to pivoting movement between the first frame member and the second frame member.

According to further aspects of the present invention, an exercise device comprises an exercise brace, a first strap, a second strap and a resistance band. The exercise brace includes a first frame member and a second frame member that pivotably couples to the first frame member. The first strap couples to the first frame member about an end portion thereof to temporarily attach the exercise device to a user. Similarly, the second strap couples to the second frame member about an end portion thereof to temporarily attach the exercise device to the user. The resistance band couples to the exercise brace such that the resistance band creates a resistance to pivoting movement between the first frame member and the second frame member.

According to still further aspects of the present invention, a method of providing multiple exercises in a single exercise device is provided. The method comprises providing an exercise brace having a first frame member and a second frame member that pivotably couples to the first frame member. The method also comprises providing a first strap that couples to the first frame member about an end portion thereof to temporarily attach the exercise device to a user and providing a second strap that couples to the second frame member about an end portion thereof to temporarily attach the exercise device to the user. The method still further comprises providing a resistance band that couples to the exercise brace and providing a first band engaging member extending from the exercise brace and a second band engaging member extending from the exercise brace, each band engaging member arranged such that when the resistance band is brought into contact with a selected band engaging member, the resistance band creates a resistance to pivoting movement between the first frame member and the second frame member.

The method may further comprise positioning each of the first and second band engaging members along the first frame member such that the exercise device provides a push exercise when the resistance band is brought into contact with a first one of the first and second band engaging members, and the exercise device provides a pull exercise when the resistance band is brought into contact with a second one of the first and second band engaging members.

The method may also comprise providing at least one feature on the exercise brace that allows the user to adjust the resistance provided by the resistance band, e.g., by adjusting the position of the resistance band on the exercise brace, by adjusting the number, size, length, thickness, resilience, or other aspect of the resistance band or by using other suitable techniques, examples of which are set out in greater detail herein.

DETAILED DESCRIPTION

Figure 1:
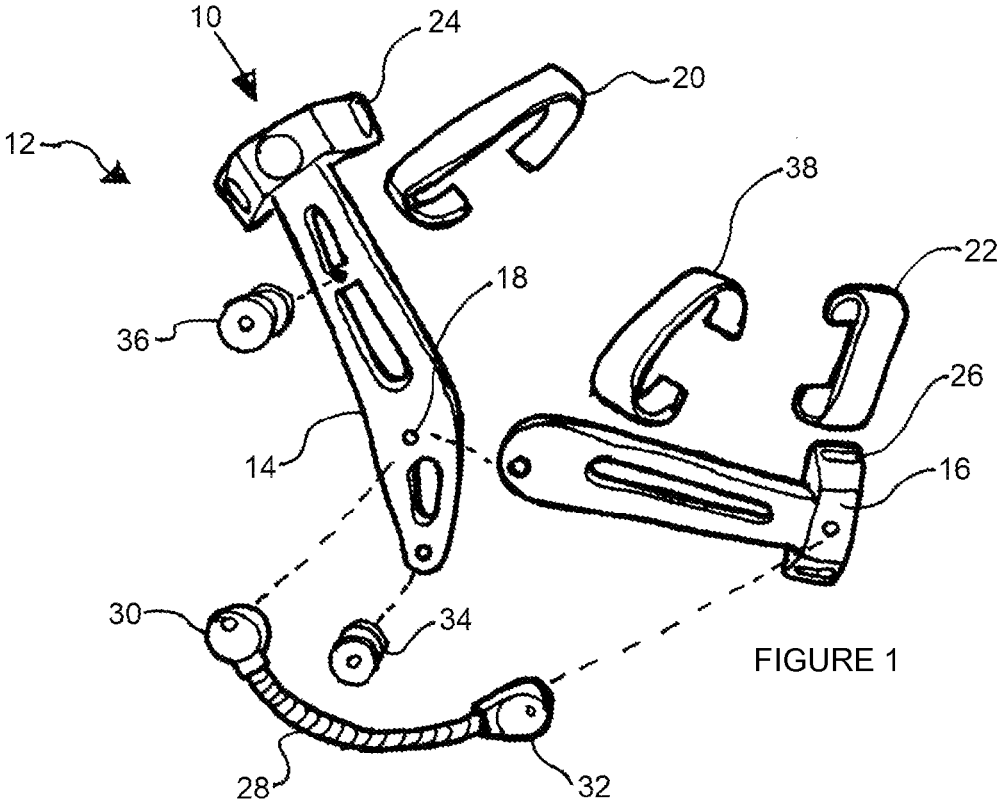
FIG. 1 illustrates an exercise device according to aspects of the present invention, as an exploded parts view.

Referring now to the drawings, and in particular, to FIG. 1, an exercise device 10 is illustrated according to various aspects of the present invention. The exercise device 10 is illustrated in an exploded view in FIG. 1 for purposes of clarity of explanation of the exercise device components. The exercise device 10 comprises an exercise brace 12 having a first frame member 14 and a second frame member 16 that pivotably couples to the first frame member 14. For instance, as illustrated in the exemplary implementation, the second frame member 16 pivots relative to the first frame member 14 about a pivot point 18. In the illustrative implementation, the first frame member 14 defines an upper structure and the second frame member 14 defines a lower structure of the exercise brace 12. Also, as illustrated, the first frame member 14 is longer than the second frame member 16. In this regard, the pivot point 18 is approximately in the middle of the overall length of the brace 12 when the first frame member 14 and the second frame member 16 are end to end.

A first strap 20 couples to the first frame member 14 about an end portion thereof to temporarily attach the exercise device 10 to a user, e.g., to a limb of the user, as will be described in greater detail herein. Analogously, a second strap 22 couples to the second frame member about an end portion thereof to temporarily attach the exercise device to the user. As an illustrative implementation, the first strap 20 (also referred to as an upper strap 20), and the second strap 22 (also referred to as a lower strap 22) may each be implemented using Velcro® or other hook and loop fastener, a strap with a buckle and clasp or other arrangement for temporarily fastening the device to a person. Moreover, the first frame member 14 may include a feature such as a slot arrangement 24 for receiving the first strap 20. Similarly, the second frame member 16 may include a slot arrangement 26 for receiving the second strap 22.

The exercise device 10 also includes a resistance band 28 that couples to the exercise brace 12. The resistance band 28 provides resistance during exercise operations, to pivoting movement between the first frame member 14 and the second frame member 16. As illustrated, the resistance band 28 includes a first end member 30 and a second member 32. The first and second end members 30, 32 provide attachment features, and in some illustrative embodiments, provide pivoting, rotating and/or other forms of movement as will be described in greater detail below. In an illustrative implementation, the resistance band 28 is coupled between the second frame member 16 and the pivot point 18. However, other connection locations may alternatively be implemented. The resistance band 28 may comprise a cord, bungee, rubber, tubing or other material that can stretch, deform or otherwise generate resistance as the second frame member 16 pivots relative to the first frame member 14.

The exercise device 10 still further comprises at least one band engaging member extending from the exercise brace 12. As illustrated, there are two band engaging members, 34 and 36 that extend from the first frame member 14. However, the illustrated embodiment of the present invention is not so limited. Rather, any number of band engaging members may be implemented in practice. Each band engaging member 34, 36 can be fixedly positioned along the corresponding frame member, e.g., the first frame member 14 as shown. Alternatively, a band engaging member may be repositionable along the corresponding frame member, e.g., using slots that allow slidable adjustment, using predefined alignment holes, etc.

Each band engaging member is arranged such that when the resistance band 28 is brought into contact with the corresponding band engaging member 34, 36, the resistance band 28 creates a resistance to pivoting movement between the first frame member 14 and the second frame member 16 about the pivot point 18.

The exercise device 10 may also optionally include a third strap 38, which couples to the exercise brace 12 adjacent to the pivot point 18 where the first frame member 14 pivotably couples to the second frame member 16. In this regard, the third strap 38 is also referred to herein as a middle strap.

Figure 2:
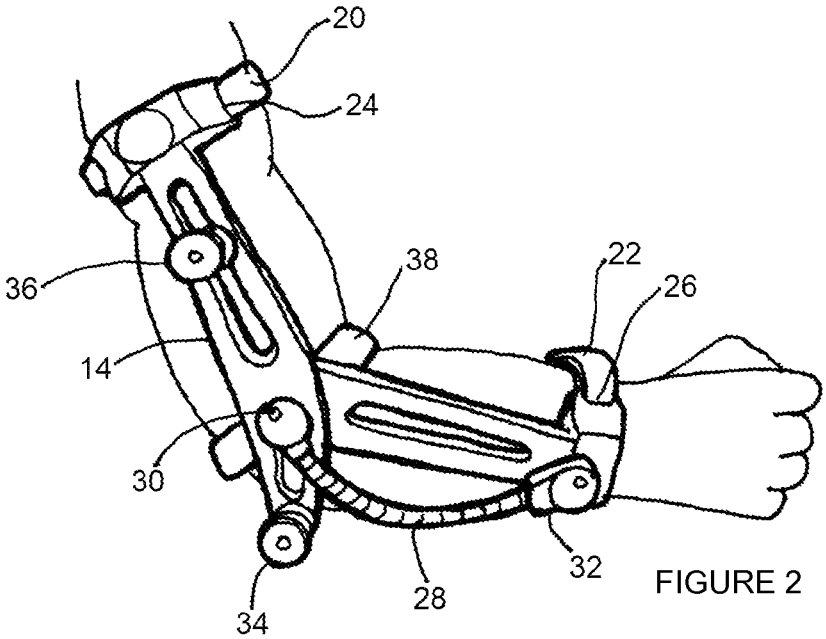
FIG. 2 illustrates the exercise device of FIG. 1, as assembly view strapped to an arm of a user.

Referring to FIG. 2, the exercise device 10 is illustrated as being worn by a user that intends to use the device to exercise. As illustrated, the first frame member 14 is strapped about the arm of the user by the first strap 20. In this regard, the term "arm" is used to refer to the limb segment between the shoulder and the elbow. Correspondingly, the second frame member 16 is strapped to the forearm of the user by the second strap 22. Here, "forearm" is used to refer to the limb segment between the elbow and wrist. The third strap 34 couples around the user's limb in close proximity to the user's elbow.

Figure 3:
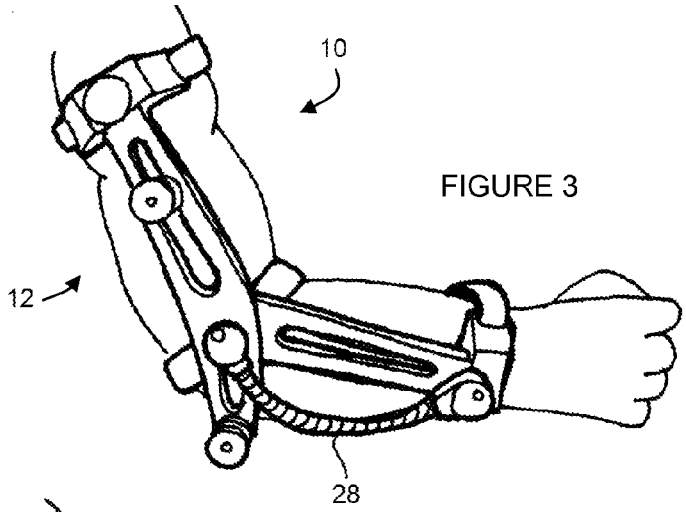
FIG. 3 illustrates an exercise device according to aspects of the present invention, where the exercise device is placed on an arm of a user, and an elastic resistance band of the exercise device is in a disengaged position.

FIG. 3 illustrates the exercise brace 12 positioned in a rested state with the resistance band 28 free floating and not connected, i.e., disassociated with all of the band engaging members 34, 36. FIG. 3 is provided to assist the reader in better understanding the steps of moving the resistance band 28 such that the exercise device 10 can be used as bicep curl exerciser.

Figure 4:
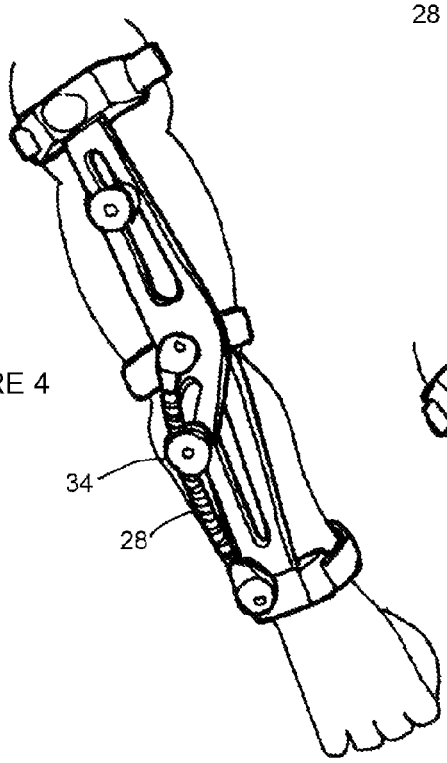
FIG. 4 illustrates the exercise device of FIG. 3 on the user's arm, with the elastic resistance band in a first engaged position, thus ready to perform an exercise such as a bicep curl.

Referring to FIG. 4, the user has flipped over the resistance band 28 so as to contact the lower band engaging member 34. Thus, the resistance band 28 is now associated with the lower band engaging member 34. In this regard, the resistance band 28 provides relatively minimal resistance when the arm is fully extended. To perform the exercise, the user performs a bicep curl by bending the arm at the elbow. During this motion, resistance is increased while the user's arm is flexed upward for a bicep curl.

Figure 5:
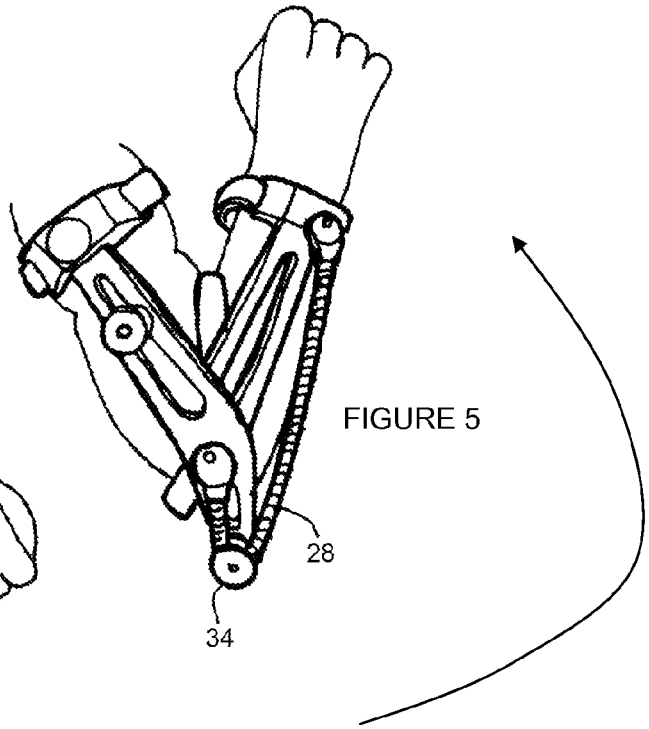
FIG. 5 illustrates the exercise device of FIG. 4 on the user's arm, with the elastic resistance band engaged, performing a bicep curl where the arm is fully flexed.

Referring to FIG. 5, the exercise device 10 is in a fully flexed position during a bicep curl. Bending the limb at the elbow causes corresponding pivoting of the second frame member 16 relative to the first frame member 14 about the pivot point 18. This motion causes the resistance band 28, in cooperation with the band engaging member 34, to stretch, providing resistance to the movement.

The user performs the exercise for as many reps as deemed necessary. Each time the limb transitions from the fully extended position to the fully flexed position, the second frame member 16 pivots about the pivot point 18 relative to the first frame member 14. However, because the resistance band 28 is routed behind the band engagement member 32, the resistance band is stretched as the limb bends at the elbow.

In an illustrative exemplary implementation, the band engaging member 32 comprises a pulley. However, in practice, the band engaging member may comprise a post, grooved member or other device that contacts the resistance band 28. In this regard, the band engaging member 34 may reduce friction, such as by providing a surface that rolls, rotates, slides or otherwise engages with the resistance band 28.

Moreover, as illustrated, the resistance band 28 has a first end 30 that couples to the pivot point 18 between the first frame member 14 and the second frame member 16. In this regard, the pivot point 18 serves as a central pivot point of the device 10. The resistance band 28 also comprises a second end 32 that couples to the end portion of the second frame member 16, e.g., adjacent to the second support strap 22. In an illustrative exemplary implementation, the first and second ends 30, 32 of the resistance band 28 are pivotable relative to the exercise brace 12. For instance, in an exemplary implementation, the second frame member 16 includes a receiving hole for receiving an end of the resistance band 28. The end 32 may snap, click, pop, or otherwise engage the receiving hole. A similar mechanism is also used to couple the first end 30 to the pivot point 18. In this regard, the first and second frame members 14, 16 can pivot relative to each other during exercise while allowing the resistance band 28 to pivot independently. However, other arrangements may alternatively be implemented.

Figure 6:
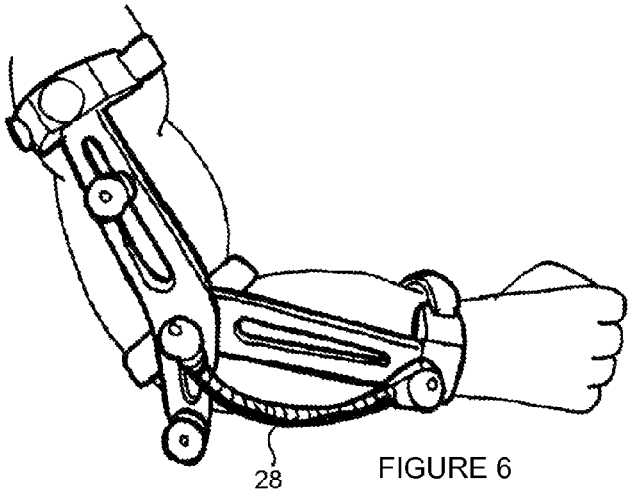
FIG. 6 illustrates the exercise device of FIG. 3 where the elastic resistance band of the exercise device is in a disengaged position.

Referring to FIG. 6, the exercise device 10 is positioned in a rested state with the resistance band 28 free floating and not connected, i.e., disassociated with all of the band engaging members 34, 36.

Figure 7:
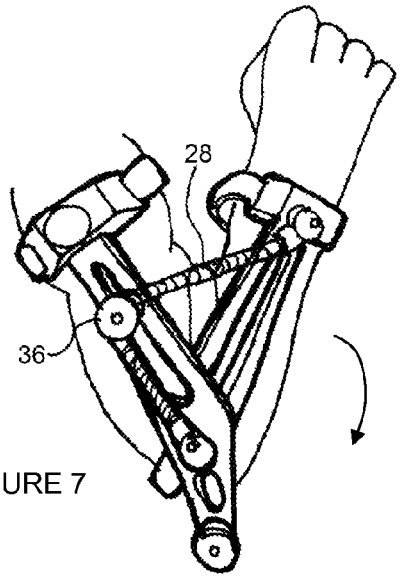
FIG. 7 illustrates the exercise device of FIG. 6 on the user's arm, with the elastic resistance band in a second engaged position, thus ready to perform an exercise such as a triceps extension.

Referring to FIG. 7, the user has slipped the resistance band 28 around the second resistance band engaging member 36, which is coupled to the first frame member 14 proximate to the first strap 20. Thus, the resistance band 28 is now associated with the upper band engaging member 36. The device is now suitably configured to perform as a triceps curl exerciser. Notably, the user's elbow is in a bent position and the resistance band 28 is generally un-stretched.

Figure 8:
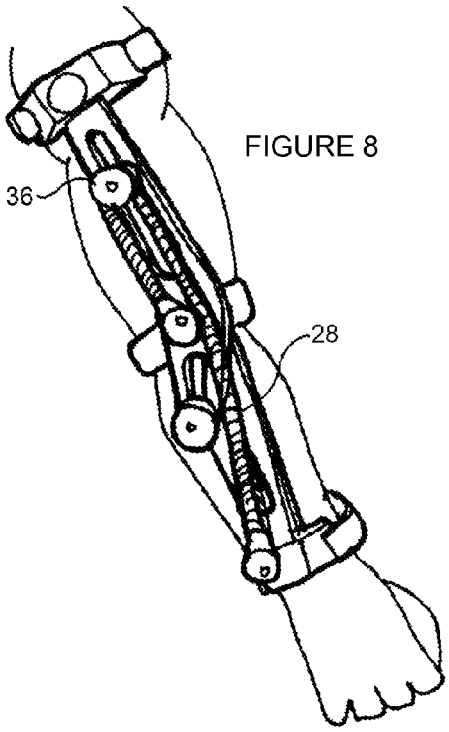
FIG. 8 illustrates the exercise device of FIG. 7 on the user's arm, with the elastic resistance band engaged, performing a triceps extension where the arm is fully extended.

Referring to FIG. 8, the limb is fully extended during triceps extension. As the user straightens out the bend at the elbow, the resistance band 28 is stretched, thus applying resistance to the limb movement. The triceps exercise of FIGS. 6-8 can be performed over and over as the resistance band 28 stretches and relaxes in cooperation with the second resistance band engaging member 36. Where the second band engaging member 36 comprises a pulley, the resistance for the triceps exercise is generated as the band 28 rolls through the pulley. However, in practice, the band engaging member 36 can comprise other structures, examples of which are analogous to the band engaging member 32, described above.

Figure 9:
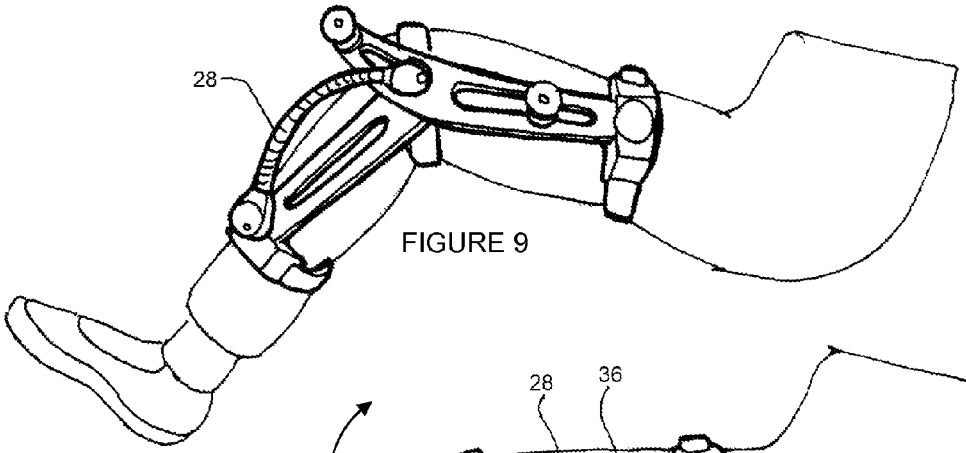
FIG. 9 illustrates an exercise device according to aspects of the invention, where the exercise device is placed on a leg of a user, and an elastic resistance band of the exercise device is in a disengaged position.

Referring to FIG. 9, the exercise device 10 is strapped to a lower limb of the user. In this manner, the first frame member 14 is strapped to the thigh of the user by the first strap 20. The second frame member 16 is strapped to the crus (calf/shin) of the user by the second strap 22. In FIG. 9, the device 10 is in a rest state with the resistance band disassociated with the corresponding band engaging members 34, 36. This figure is illustrated to better convey an understanding of the steps of moving the resistance band 28 to be placed in position so that the exercise device 10 can be used as a leg extension to work the quadriceps muscle.

Figure 10:
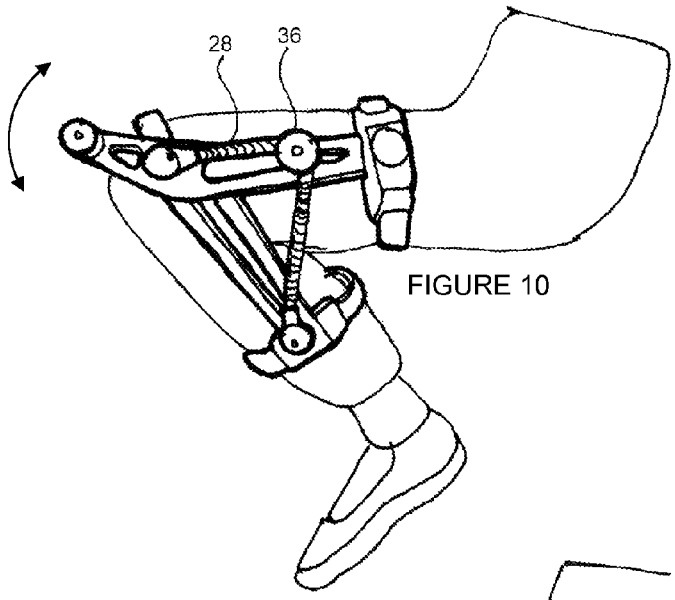
FIG. 10 illustrates the exercise device of FIG. 9 on the user's leg, with the elastic resistance band in a first engaged position, thus ready to perform an exercise such as a leg extension.

Referring to FIG. 10, the user has slipped the resistance band 28 around the second resistance band engaging member 36, which is coupled to the first frame member 14 proximate to the first strap 20. Thus, the resistance band 28 is now associated with the upper band engaging member 36. The device is now suitably configured to perform as a quadriceps exerciser. Notably, the user's knee is in a bent position and the resistance band 28 is generally un-stretched.

Figure 11:
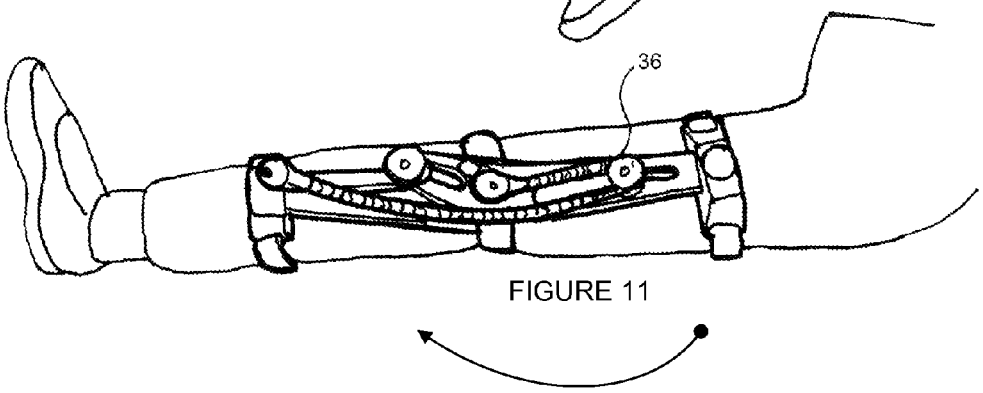
FIG. 11 illustrates the exercise device of FIG. 10 on the user's leg, with the elastic resistance band engaged, performing a leg extension where the leg is fully extended.

Referring to FIG. 11, the limb is fully extended during quadriceps extension. As the user straightens out the bend at the knee, the resistance band 28 is stretched, thus applying resistance to the limb movement. The quadriceps exercise of FIGS. 9-11 can be performed over and over as the resistance band 28 stretches and relaxes in cooperation with the second resistance band engaging member 36. Where the second band engaging member comprises a pulley, the resistance for the quadriceps exercise is generated as the band 28 rolls through the pulley. However, in practice, the band engaging member 36 can comprise other structures, examples of which are analogous to the band engaging member 32, described above.

Figure 12:
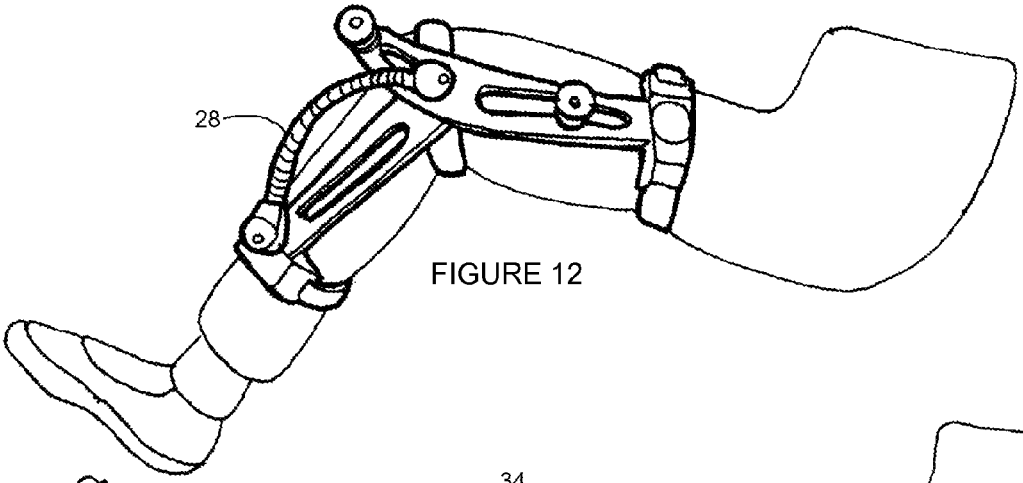
FIG. 12 illustrates the exercise device of FIG. 9 on the user's leg according to aspects of the invention, where the elastic resistance band of the exercise device is in a disengaged position.

Referring to FIG. 12, the device 10 is in a rest state with the resistance band 28 disassociated with the corresponding band engaging members 34, 36. This FIGURE is illustrated to better convey an understanding of the steps of moving the resistance band 28 to be placed in position so that the exercise device 10 can be used as a leg extension to work the hamstring muscle.

Figure 13:
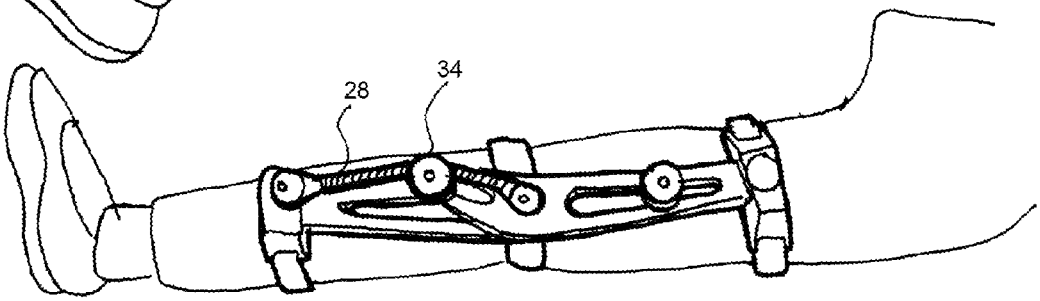
FIG. 13 illustrates the exercise device of FIG. 12 on the user's leg, with the elastic resistance band in a second engaged position, thus ready to perform an exercise such as a leg curl.

Referring to FIG. 13, the user has slipped the resistance band 28 around the first resistance band engaging member 34, which is coupled to the first frame member 14 opposite of the first strap 20. Thus, the resistance band 28 is now associated with the lower band engaging member 34. The device is now suitably configured to perform as a hamstring exerciser. In this regard, the resistance band 28 provides relatively minimal resistance when the leg is fully extended. To perform the exercise, the user performs a leg curl by bending the leg at the knee. During this motion, resistance is increased while the user's leg is flexed for a leg curl.

Figure 14:
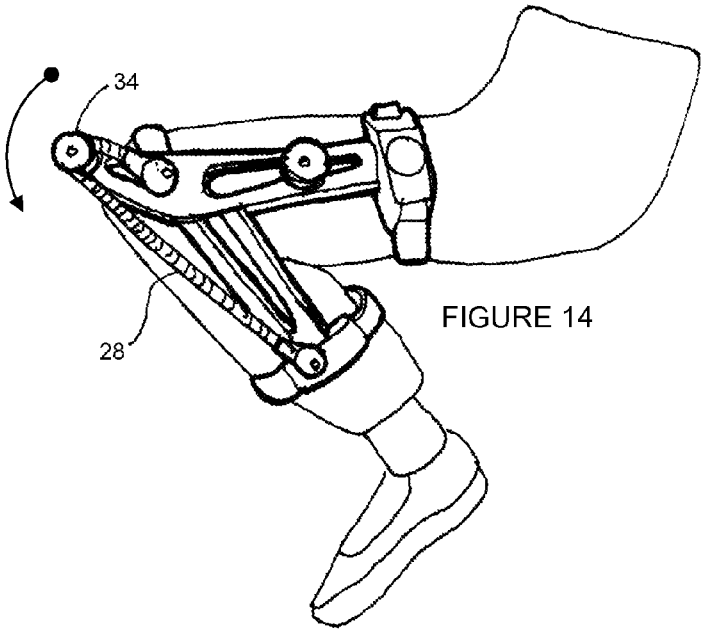
FIG. 14 illustrates the exercise device of FIG. 13 on the user's leg, with the elastic resistance band engaged, performing a leg curl where the leg is fully flexed in a closed position.

Referring to FIG. 14, the leg is bent at the knee. The exercise device 10 is in a fully flexed position during a leg curl. Bending the limb at the knee causes corresponding pivoting of the second frame member 16 relative to the first frame member 14 about the pivot point 18. This motion causes the resistance band 28, in cooperation with the band engaging member 34, to stretch, providing resistance to the movement. The hamstring exercise of FIGS. 12-14 gives the user resistance while the leg is flexed inward for a leg curl to exercise to the hamstring muscle, and can be performed over and over as the resistance band 28 stretches and relaxes in cooperation with the second resistance band engaging member 34.

According to various embodiments of the present invention, the exercise device 10 provides a first band engaging member 34 that couples to the first frame member and a second band engaging member 36 that also couples to the first frame member. The second frame member 16 pivotably couples to the first frame member 14 at a position along the first frame member 14 between the first band engaging member 34 and the second band engaging member 36. In this manner, the device 10 provides a first exercise when the resistance band engages the first band engaging member 34 and the device 10 provides a second exercise when the resistance band engages the second band engaging member 36. Moreover, the first and second exercises provide resistance in generally opposite directions, allowing different muscle groups to be exercised.

As noted in greater detail herein, the first band engaging member 34, e.g., a pulley, couples to the first frame member 14. The first band engaging member 34 is located along the first frame member 14 generally towards the first strap 20. The second band engaging member 36 couples to the first frame member 14 generally towards an end portion opposite of the first strap 20, i.e., towards the opposite end as the first band engaging member 34.

Figure 15:
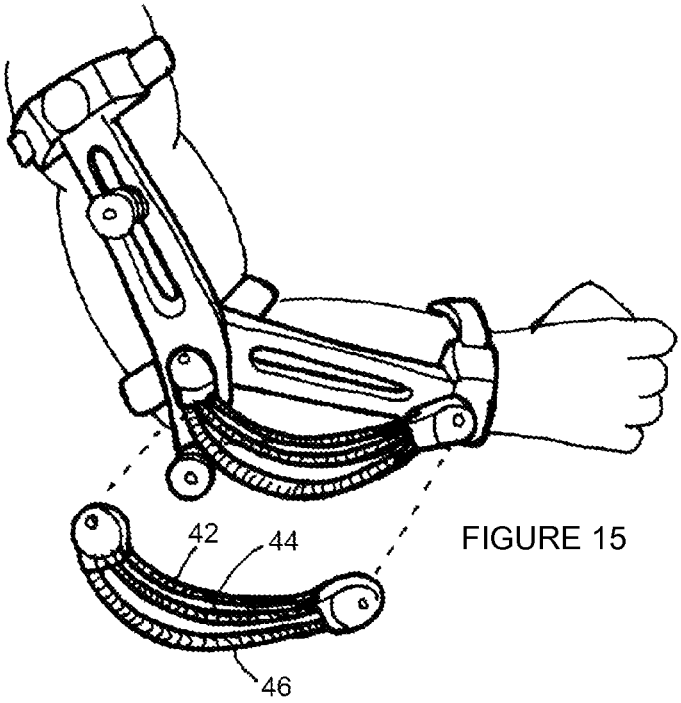
FIG. 15 illustrates an exercise device according to aspects of the present invention, with an elastic band system that enables the user to adjust between a multitude of resistance options.

Referring to FIG. 15, an alternative embodiment and method of resistance for the exercise device 10 is illustrated according to aspects of the present invention. As illustrated, the resistance band 28 comprises a multiple elastic cord assembly that includes, for instance, a thin elastic cord 42, medium elastic cord 44, and thick elastic cord 46. The user selects one of the three, or a combination of the three elastic cords to use and to flip onto the appropriate resistance band engaging members 34, 36. This provides the user with a variety of resistance choices for exercising the bicep arm curl, triceps extension for arm, quadriceps leg extension, and hamstring leg curl. Other numbers and/or combinations of cords can alternatively be utilized.

Figure 16:
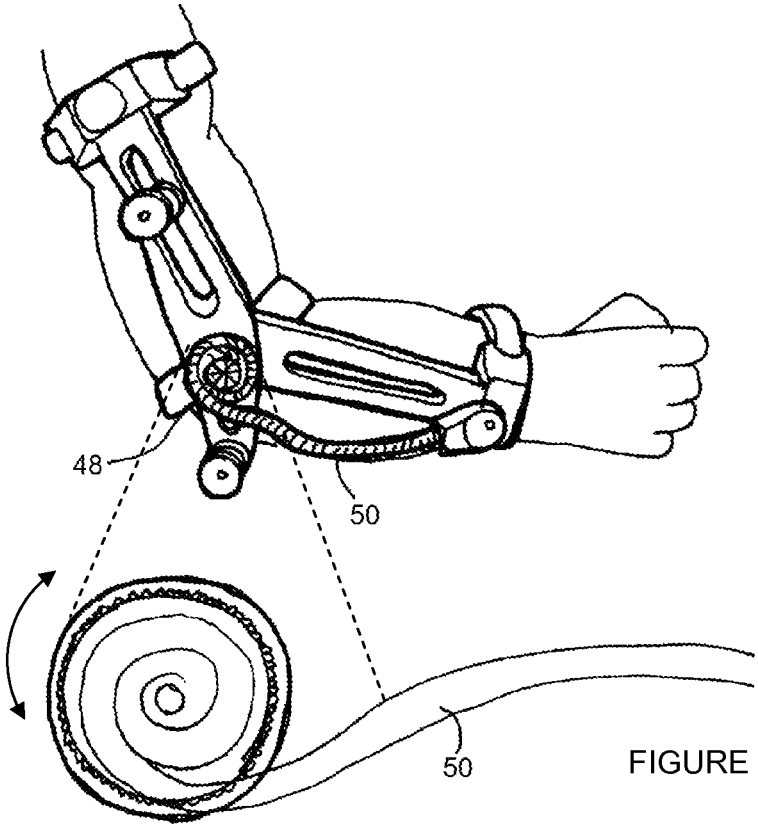
FIG. 16 illustrates an exercise device according to further aspects of the present invention, that utilizes a ratchet for adjustable tensioning.

Referring to FIG. 16, an exercise device 10 is illustrated according to further aspects of the present invention. As illustrated, the device utilizes a ratchet mechanism 48, e.g., a central ratchet drum, which allows the elastic cord of the resistance band 50, e.g., a rubber tube, to be lengthened or shortened. Thus, the user can change the length and resistance of the elastic cord by turning the central ratchet drum. This gives the user a variety of resistance choices for exercising the bicep arm curl, triceps arm, quadriceps leg extension and hamstring leg curl. Otherwise, the implementation of FIG. 16 operates substantially as set out herein.

Figure 17:
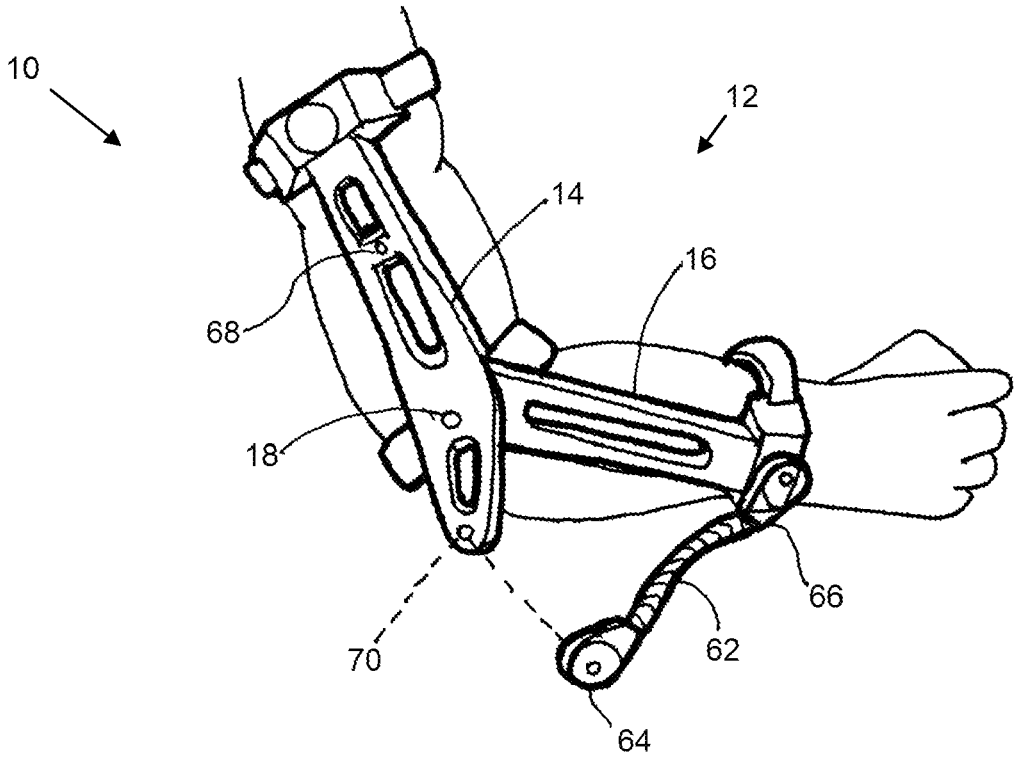
FIG. 17 illustrates an exercise device according to yet further aspects of the present invention, having an elastic band system that allows the user to remove one or both ends for reattaching and repositioning.

Referring to FIG. 17, an exercise device 10 is illustrated according to further embodiments of the present invention. The exercise brace 12 is substantially as described in greater detail herein, except as noted below. As illustrated, a resistance band 62 is removable from the exercise brace 12. For instance, a first end 64, a second end 66 or both the first and second ends 64, 66 can be detached from the exercise brace 12. In this regard, the ends 64, 66 can also be pivoting or implement other features in a manner analogous to that set out in greater detail herein. As illustrated, the first frame member 14 comprises a plurality of holes 68, 70 therein. The end 64 of the resistance band 28 can thus be positioned in cooperation with any one of the holes 68, 70. The user selection of a particular hole 68, 70 determines whether the device 10 provides a pulling or pushing resistance. For instance, when the end 64 of the resistance band 62 is mounted over the upper hole mount 68, then exercise device 10 can be used on arm for triceps extension and leg for leg extension. When the end 64 of the resistance band 62 is mounted over the lower position hole 70, then unit can be used on arm for bicep curl or leg for hamstring curl.

Various aspects of the present invention provide a brace for exercising that can be quickly and easily strapped onto a limb, e.g., arm or leg, for exercise. The exercise device is compact and portable. In general, the exercise device 10 has a first frame member 14 and a second frame member 16 that pivots therebetween such that when worn, the pivot point corresponds to a position proximate to an elbow or knee, depending upon how the exercise device is being used. The resistance band 28, e.g., an elastic cord, connects the upper part of the brace with the lower part of the brace. This makes it possible to create resistance for a leg or arm exercise in a flexing or extending motion.

The exercise device 10 can be used while sitting down in a chair or couch. The exercise device can also be used while walking, running, dancing, doing aerobics or exercising giving the person more resistance for a more strenuous workout. Because the exercise device 10 is strapped onto the arm or leg it doesn't require the use of hands, wrist, ankles or feet to perform the various exercises. Because of this, the exercise device isolates the arm and leg muscles without stressing the hand, wrist, ankle, or feet muscles.

When the exercise device 10 is strapped to the arm, two exercises can be performed independently. A bicep curl can be performed in an upward motion when the elastic band is put into one position. A triceps extension can be performed in a downward motion when the elastic band is put into another position.

When the exercise device is strapped to the leg, two exercises can also be performed. The hamstring can be exercised in a downward motion when the elastic band is put into one position. A quadriceps muscle can be exercised in an upward motion when the elastic band is put into another position.

Having thus described the invention of the present application in detail and by reference to embodiments thereof, it will be apparent that modifications and variations are possible without departing from the scope of the invention defined in the appended claims.

What is claimed is:

1. An exercise device, comprising:

an exercise brace having:

a first frame member; and a second frame member that pivotably connects to the first frame member such that the second frame member pivots relative to the first frame member about a pivot point;

a first strap that couples to the first frame member about an end portion thereof to temporarily attach the exercise device to a user;

a second strap that couples to the second frame member about an end portion thereof to temporarily attach the exercise device to the user;

a first band engaging member that extends from the first frame member;

a second band engaging member that extends from the first frame member spaced apart from the first band engaging member; and a resistance band having:

a first end that is connected to at least one of the first frame member and the second frame member so as to be positioned between and spaced apart from both the first band engaging member and the second band engaging member; and a second end that attaches to the second frame member;

wherein:

the pivot point is located at a position along the first frame member between the first band engaging member and the second band engaging member; and when the resistance band is brought into contact with at least one of the first band engaging member and the second band engaging member, the resistance band creates a resistance to pivoting movement between the first frame member and the second frame member.

2. The exercise device according to claim 1, wherein at least one of the first band engaging member and the second band engaging member comprises a pulley.

3. The exercise device according to claim 1, wherein the first end of the resistance band couples to the pivot point between the first frame member and the second frame member, and the second end of the resistance band couples to the end portion of the second frame member.

4. The exercise device according to claim 3, wherein the first and second ends of the resistance band are pivotable relative to the exercise brace.

5. The exercise device according to claim 1, further comprising a third strap that couples to the exercise brace adjacent to where the second frame member pivotably connects to the first frame member.

6. The exercise device according to claim 1, wherein:

the first band engaging member and the second band engaging member are spaced apart such that the exercise device provides a first exercise when the resistance band engages the first band engaging member and the exercise device provides a second exercise when the resistance band engages the second band engaging member.

7. The exercise device according to claim 1, wherein the resistance band comprises:

at least one elastic cord.

8. The exercise device according to claim 7, wherein the at least one elastic cord comprises a plurality of elastic cords, where the user can utilize any combination of cords to set a desired resistance.

9. The exercise device according to claim 1, wherein the first end of the resistance band couples to a ratchet mechanism that is operated to adjust the length of the resistance band extending therefrom.

10. The exercise device according to claim 1, wherein at least one of the first band engaging member and second band engaging member is user repositionable on the first frame member.

11. An exercise device, comprising:

an exercise brace having:

a first frame member; and a second frame member that pivotably connects to the first frame member such that the second frame member pivots relative to the first frame member about a pivot point;

a first strap that couples to the first frame member to temporarily attach the exercise device to a user;

a second strap that couples to the second frame member to temporarily attach the exercise device to the user;

a first band engaging member that extends from the first frame member; and a second band engaging member that extends from the first frame member spaced apart from the first band engaging member; and a resistance band having:

a first end that is connected to at least one of the first frame member and the second frame member so as to be positioned between and spaced apart from both the first band engaging member and the second band engaging member; and a second end that attaches to the second frame member;

wherein:

the first band engaging member and the second band engaging member are spaced apart such that the exercise device provides a first exercise when the resistance band engages the first band engaging member and the exercise device provides a second exercise when the resistance band engages the second band engaging member.

12. The exercise device according to claim 11, wherein at least one of the first end and the second end of the resistance band detachably releases from the exercise brace and reattaches to a select one of at least two positions.

13. The exercise device according to claim 11, wherein the first end of the resistance band detachably couples to the first frame member at a select one of at least two positions, and the second end of the resistance band that detachably couples to the second frame member at an end portion thereof.

14. The exercise device according to claim 11, further comprising a third strap that couples to the exercise brace adjacent to where the second frame member pivotably connects to the first frame member.

15. The exercise device according to claim 11, wherein the resistance band comprises:

at least one elastic cord.

16. The exercise device according to claim 15, wherein the at least one elastic cord comprises a plurality of elastic cords, where the user can utilize any combination of cords to set the resistance to a desired resistance.

17. The exercise device according to claim 11, wherein the first end of the resistance band couples to a ratchet mechanism that is operated to adjust the length of the resistance band extending therefrom.

* * * * *